US008973173B2

(12) United States Patent
Elam et al.

(10) Patent No.: US 8,973,173 B2
(45) Date of Patent: Mar. 10, 2015

(54) ENVIRONMENTAL SYSTEM FOR MOTORSPORTS HELMETS

(76) Inventors: Todd E. Elam, Sahuarita, AZ (US); Renee J. Elam, Sahuarita, AZ (US)

( * ) Notice: Subject to any disclaimer, the term of this patent is extended or adjusted under 35 U.S.C. 154(b) by 274 days.

(21) Appl. No.: 13/438,677

(22) Filed: Apr. 3, 2012

(65) Prior Publication Data

US 2012/0246809 A1 Oct. 4, 2012

Related U.S. Application Data

(60) Provisional application No. 61/471,606, filed on Apr. 4, 2011.

(51) Int. Cl.

| | |
|---|---|
| ***A42B 1/08*** | (2006.01) |
| ***A42B 3/28*** | (2006.01) |
| ***A42B 3/04*** | (2006.01) |

(Continued)

(52) U.S. Cl.

CPC ..... *A42B 3/286* (2013.01); *A42B 3/048* (2013.01); *A42B 3/227* (2013.01); *A42B 3/30* (2013.01)

USPC ..... 2/424; 2/171.3; 2/425

(58) Field of Classification Search

CPC ..... A42B 3/20; A42B 3/222; A42B 3/225; A42B 3/226; A42B 3/04; A42B 3/326; A42B 3/223; A42B 3/24; A42B 3/22; A42B 3/221; A42B 3/227; A42B 3/286; A42B 3/18; A42B 3/0473; A42B 3/185; A42B 3/00; A42B 3/0406

USPC ..... 2/424, 410

See application file for complete search history.

(56) References Cited

U.S. PATENT DOCUMENTS

| | | | | |
|---|---|---|---|---|
| 1,366,437 | A * | 1/1921 | Wagenhorst | 128/202.15 |
| 3,736,927 | A | 6/1973 | Misaqi | |

(Continued)

FOREIGN PATENT DOCUMENTS

| | | |
|---|---|---|
| CN | 1513392 | 7/2004 |
| GB | 2032284 | 5/1980 |

(Continued)

OTHER PUBLICATIONS

Website, http://www.cyclegear.com/spqm.cfm?L1=&L2=&L3=&L4=&item=HEL_0145-0109-05, two sheets printed from the internet on Jan. 28, 2011.

(Continued)

*Primary Examiner* — Alissa L Hoey
*Assistant Examiner* — Catherine M Ferreira
(74) *Attorney, Agent, or Firm* — Richard C. Litman

(57) ABSTRACT

The environmental system for motorsports helmets includes a helmet and backpack containing various components of the system. The helmet includes an inlet and air passages for forced air ventilation, a tube conducting drinking water from a helmet inlet to the mouth of the helmet wearer, and a radio communications headset. The helmet is a full-face helmet having an openable transparent face shield and visor formed with the face shield as a unit. A backpack is provided with the helmet, the backpack containing a motor driven fan to supply air to the helmet. The air is filtered through an external filter on the pack, before entering the fan and ventilation system. A water tank is also included in the backpack, allowing the helmet wearer to draw water from the supply. A conventional communications transceiver is also provided with the backpack, the transceiver connecting to the headset within the helmet.

2 Claims, 3 Drawing Sheets

(51) Int. Cl.
*A42B 3/22* (2006.01)
*A42B 3/30* (2006.01)

(56) References Cited

U.S. PATENT DOCUMENTS

| | | | | | |
|---|---|---|---|---|---|
| 3,822,698 | A | | 7/1974 | Guy | |
| 3,963,021 | A | | 6/1976 | Bancroft | |
| 4,430,995 | A | | 2/1984 | Hilton | |
| 4,502,480 | A | | 3/1985 | Yamamoto | |
| 4,549,541 | A | | 10/1985 | Sundahl | |
| 4,549,542 | A | | 10/1985 | Chien | |
| 4,590,951 | A | | 5/1986 | O'Connor | |
| 4,681,244 | A | * | 7/1987 | Geddie | 222/144.5 |
| 4,813,083 | A | * | 3/1989 | Davidson | 2/422 |
| 5,060,833 | A | | 10/1991 | Edison et al. | |
| 5,085,349 | A | | 2/1992 | Fawcett | |
| 5,125,402 | A | | 6/1992 | Greenough | |
| 5,245,994 | A | | 9/1993 | Chang et al. | |
| 5,394,870 | A | | 3/1995 | Johansson | |
| 5,400,934 | A | | 3/1995 | Ducros | |
| 5,427,290 | A | * | 6/1995 | Thatcher | 224/148.2 |
| 5,533,500 | A | | 7/1996 | Her-Mou | |
| 5,655,374 | A | * | 8/1997 | Santilli et al. | 62/3.5 |
| 5,749,359 | A | | 5/1998 | Hansen | |
| 5,816,457 | A | | 10/1998 | Croft | |
| 5,913,456 | A | | 6/1999 | Dikeman | |
| 6,212,959 | B1 | | 4/2001 | Perkins | |
| 6,766,537 | B1 | | 7/2004 | Maki et al. | |
| 6,804,836 | B2 | * | 10/2004 | Grilliot et al. | 2/455 |
| 6,904,616 | B1 | | 6/2005 | Maki et al. | |
| 7,735,156 | B2 | * | 6/2010 | VanDerWoude et al. | 2/410 |
| 2002/0092877 | A1 | | 7/2002 | Bowman | |
| 2002/0104153 | A1 | * | 8/2002 | Benedict et al. | 2/424 |
| 2002/0104533 | A1 | | 8/2002 | Kalhok et al. | |
| 2002/0113101 | A1 | | 8/2002 | Skillern | |
| 2003/0135915 | A1 | * | 7/2003 | Luppi | 2/424 |
| 2008/0006268 | A1 | | 1/2008 | Hanlon | |
| 2010/0300435 | A1 | | 12/2010 | Thiruppathi | |

FOREIGN PATENT DOCUMENTS

| | | |
|---|---|---|
| GB | 2103095 | 2/1983 |
| JP | 2000-303245 | 10/2000 |

OTHER PUBLICATIONS

Website, http://www.ridercommunicators.com/Radio-Communicators-Intercoms/SENA/User-Reviews-SENA-SMH10-Bluetooth-Wireless-Motorcycle-Helmet-Headset-Communicator.aspx, two sheets printed from the internet on Jan. 28, 2011.

* cited by examiner

ENVIRONMENTAL SYSTEM FOR MOTORSPORTS HELMETS

CROSS-REFERENCE TO RELATED APPLICATION

This application claims the benefit of U.S. Provisional Patent Application Ser. No. 61/471,606, filed Apr. 4, 2011.

BACKGROUND OF THE INVENTION

1. Field of the Invention

The present invention relates to protective headgear, and particularly to an environmental system for motorsports helmets that includes a forced air ventilation system, water supply, communications radio, and a backpack containing most of the functional elements, which communicate with the helmet.

2. Description of the Related Art

The importance and value of protective helmets in motorsports has become increasingly recognized over the years. Motorsports helmets meeting certain specific standards are required in all organized motorsports, as well as being required for use by motorcyclists for travel on public roads. Such protective helmets are required for use in off-road riding by motorcyclists as well, in virtually all jurisdictions.

The so-called "full-face" or completely enclosed helmet has become increasingly popular due to the increased protection provided, and is in fact required in many motorsports venues. A drawback of such full-face helmets is their relative lack of ventilation. While virtually all helmet manufacturers provide passive ventilation means to various degrees in their full-face helmets, such helmets are still generally quite stifling when worn on a warm or hot day. As a result, some high-end helmets are provided with inlets to accept forced air from some external source. While this can be quite useful in a race car, the typical motorcyclist or all-terrain vehicle (ATV) operator is unable to take advantage of such a provision for forced air ventilation, as there is no place to install the motor, fan, and power supply for such a system on a motorcycle and most ATVs do not provide for such either. Yet, the full-face helmet is arguably of more value to the motorcyclist or operator of an open ATV than it is to the driver of an enclosed car, where the structure of the car provides some additional protection.

The exposed position of the motorcyclist or ATV operator when riding leads to other problems as well, particularly in off-road riding, e.g., desert riding in the Southwest. The dry conditions invariably result in the rider encountering significant amounts of dirt and dust during a ride, particularly if the rider is trailing another rider(s). The importance of avoiding the inhalation of significant amounts of dust has been increasingly recognized, as ingestion of such dust over a prolonged period is now known to result in silicosis in many people who have been subjected to such exposure. In the past, it was customary for riders in such conditions to tie a handkerchief or bandanna over their lower faces in an attempt to reduce the ingestion and inhalation of dirt and dust, but such a solution was not as effective as desired. More recently, motorcycle riders and ATV operators have used full-face helmets with passive air filters, i.e., not having a powered, forced air source, to provide clean air to breathe within the helmet. However, the problem noted further above with the difficulty in providing sufficient ventilation air for comfort, particularly in hot climates, is exacerbated by the airflow restriction of such a passive filter.

Another problem encountered in such conditions is the dehydration that a driver or rider may experience. The heat encountered in an enclosed racing car is several tens of degrees warmer than ambient temperature, and the very hot and dry conditions encountered when off-road riding in the Southwest may be comparable. Accordingly, the driver or rider will require a fair amount of water during the course of the event. In auto racing events, this may be handled during pit stops or the car may contain a gallon or so of drinking water for the driver. This is clearly not possible during an extended off-road ride on a motorcycle or ATV. Yet, most lighter off-road motorcycles have no place to carry any significant amount of water to allow the rider to rehydrate during the course of the ride. Even though an ATV may be able to carry water for the operator, the lack of access due to the full-face helmet commonly worn requires the operator to stop and remove his or her helmet in order to get a drink, and this may be a frequent need in hot and dry climates.

Another concern of off-road enthusiasts is the desire to remain in communication with other participants. Aside from the nearly universal desire to remain in contact with friends and acquaintances with whom one is sharing a common enjoyable experience, the ability to communicate with others over some distance may be critical in the event of an accident or mishap. This particularly true in the case of off-road riding, if a rider is traveling alone or becomes separated from his or her group. Even the cautious rider who makes no mistakes may find himself or herself in a potential emergency situation in the event of a mechanical problem. Even when traveling in a group, the last rider in the group is not likely to be noticed by others very frequently, and it may be a matter of several miles of travel before others notice that the trailing rider is no longer with the rest of the group when no other communication means is available.

Various helmets and protective wear incorporating certain additional features have been developed in the past. An example of such is found in Japanese Patent No. 2000-303,245, published on Oct. 31, 2000. This reference describes (according to the drawings and English abstract) a full-face helmet having an electrically powered intake fan and filter in the top thereof. Air is exhausted from the bottom of the helmet during fan operation. Another example is found in Chinese Patent No. 1,513,392, published on Jul. 21, 2004. This reference describes (according to the drawings and English abstract) a complete environmental suit and sealed helmet for protecting the wearer from severe acute respiratory syndrome (SARS). The suit and helmet provide temperature regulation, drinking water, and air filtration, among other functions.

Thus, an environmental system for motorsports helmets solving the aforementioned problems is desired.

SUMMARY OF THE INVENTION

The environmental system for motorsports helmets provides a number of various environmental functions for a motorsports helmet. The helmet is of full-face configuration, i.e., having a completely encircling lower rim that extends around the chin and mouth of the wearer, and an openable transparent face shield. The helmet preferably meets the safety standards of one or more governing bodies, e.g., Department of Transportation (DOT), Snell Foundation, etc., in effect at the time of manufacture. The helmet includes a forced air ventilation inlet at the lower rear portion thereof, the inlet communicating with airflow channels or passages through the inner top and inner sides of the helmet. A protective skirt or shroud extends downward from the lower rim of the helmet, sealing around the neck of the wearer of the helmet to preclude the entry of dust, dirt, and debris into the helmet while it is being worn and supplied with filtered air from an outside source. The transparent face shield and visor are preferably provided as a unit, the visor and face shield pivoting upward as a unit to open the front of the helmet and downward to seal the front of the helmet.

The helmet may contain earphones and a microphone integrally installed therein, or may have provision for the wearer of the helmet to wear a headset incorporating such features while wearing the helmet. The helmet may also contain a tube for drinking water, either integrally formed with the helmet or installed removably therein, the tube having an outlet providing controlled flow of drinking water for the person wearing the helmet.

The person wearing the helmet is provided with a backpack containing an electrically powered fan that draws air in through a filter and distributes it to the helmet through an air hose or tube removably connected to the helmet. The backpack preferably includes an electrical storage battery power supply for fan operation, thereby precluding the need for external electrical power. The backpack also contains a water supply that connects to the drinking water tube of the helmet, allowing the helmet wearer to draw water from the supply in the backpack. The backpack also preferably includes a communications transceiver, allowing the helmet wearer to communicate with others similarly equipped. The transceiver connects to the headset of the wearer or to such a headset installed within the helmet via a conventional cable, plug jack, and receptacle connector. The transceiver is preferably a conventional unit with a self-contained electrical battery power supply, separate from the electrical power supply of the forced air fan and ventilation system.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The environmental system for motorsports helmets provides wearers with a helmet and system that serves all of the critical needs of a motorsports participant under normal conditions. While the helmet and system are particularly well suited for use in off-road riding by motorcyclists and all-terrain vehicle (ATV) operators in hot and dusty conditions of the southwest, the helmet and system is also suitable for use by operators of other vehicles in other conditions.

Figure 1:
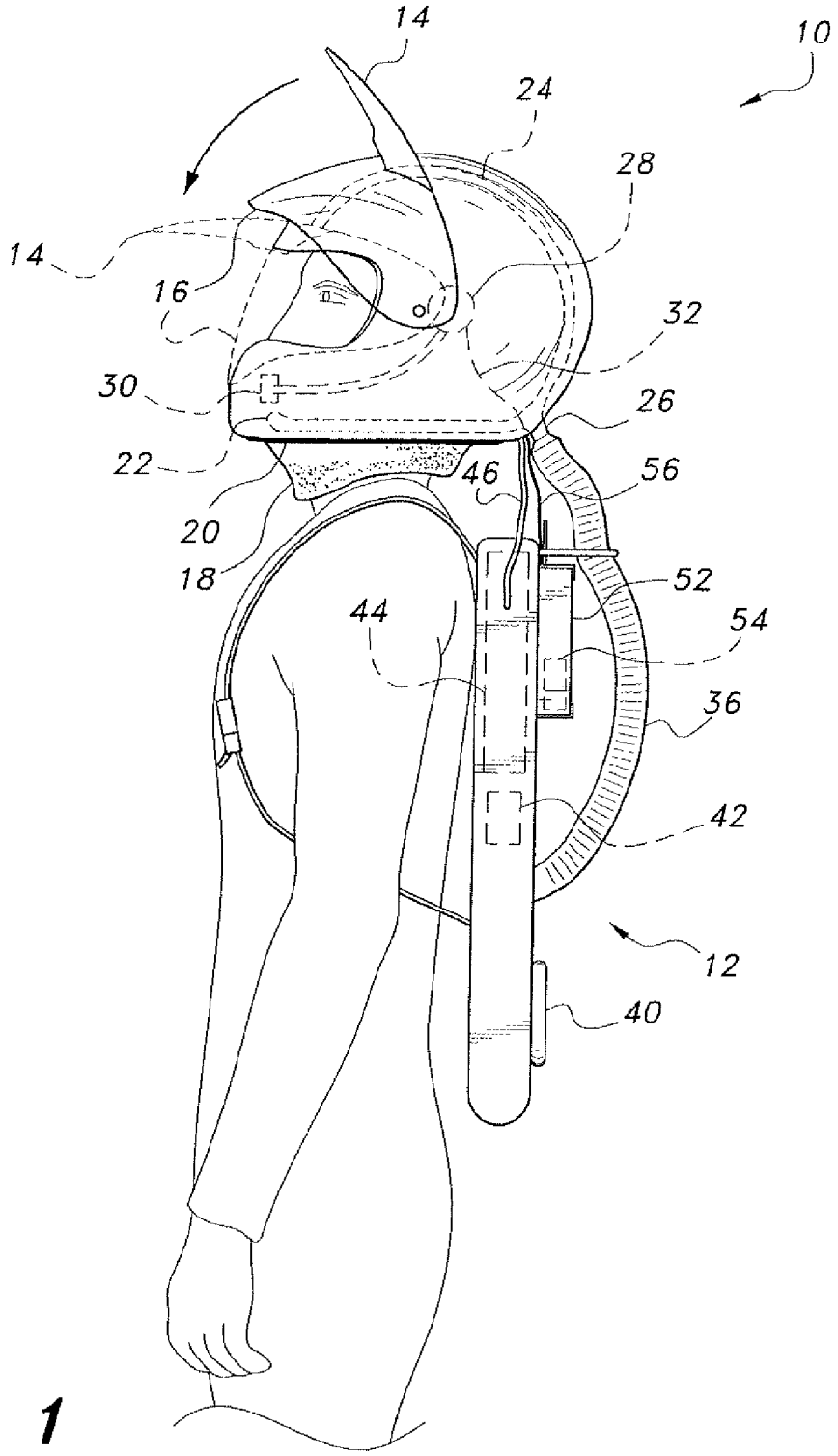
FIG. 1 is an environmental left side elevation view of an environmental system for motorsports helmets according to the present invention, shown being worn by a user of the system.

FIG. 1 of the drawings provides an environmental left side elevation view of the environmental system for motorsports helmets as it would be worn by a motorsports participant. The system includes a motorsports helmet 10 incorporating various environmental features, and a backpack 12 incorporating various systems and features and communicating with the helmet 10 to provide the desired environmental attributes to the wearer of the helmet. The helmet 10 is a "full-faced" helmet, i.e., it has a lower forward portion integrally formed therewith that wraps around the lower front of the face of the wearer, with a forward opening for vision. The helmet 10 most preferably meets the standards of at least one governing safety body, e.g., U.S. federal Department of Transportation (DOT), Snell Foundation, etc., although such approval is not absolutely required for the function of the helmet 10 and backpack 12 environmental system.

The helmet 10 includes a pivotally mounted visor 14 that may be raised or lowered by the wearer of the helmet. A replaceable transparent face shield 16 is immovably affixed to the visor 14, and moves with the visor 14 as it is raised or lowered. When the visor 14 and face shield 16 are lowered, as shown in broken lines in FIG. 1, the face shield 16 fits closely to the edges of the front opening of the helmet 10. A flexible, resilient collar or skirt 18 extends from the lower opening 20 of the helmet 10 and forms a neck seal about the neck of a person wearing the helmet 10. The neck seal, collar or skirt 18 substantially seals the lower opening 20 of the helmet 10 about the neck of the wearer, the lowered face shield 16 substantially sealing the front of the helmet from the outside environment.

The helmet 10 accordingly contains ventilation means therein to provide breathing air and to cool the head and face of the wearer. Preferably, a pair of lower lateral ventilation ducts 22 and at least one upper ventilation duct 24 are provided within the helmet 10, as shown in broken lines within the helmet 10 in FIG. 1. The lower lateral ventilation ducts 22 extend about the opposite sides of the helmet just above the lower opening 20 thereof and terminate at the lower front of the helmet 10. These lower lateral ducts 22 provide most of the breathing air for the user of the helmet, while also providing some cooling effect as well. The upper ventilation duct 24 terminates above the front opening of the helmet 10, and provides most of the cooling airflow. These ventilation ducts 22 and 24 communicate with a single ventilation inlet 26 at the lower rear of the helmet 10, the ventilation inlet 26 providing for the removable attachment of an air delivery line thereto, as discussed further below.

The helmet 10 also contains a communications radio headset 28 and microphone 30, shown in broken lines in FIG. 1. The headset and microphone may be detached from the helmet 10 and donned separately before the helmet 10 is donned. Alternatively, they may be installed integrally with the helmet 10. A communications cable 32 extends from the headset 28 within the helmet 10 to another cable extending from a radio transceiver carried on or in a backpack carried by the wearer of the helmet, discussed further below. A conventional push-to-talk switch (not shown) may be removably or permanently attached to some convenient location on the vehicle, e.g., motorcycle handlebars or ATV steering wheel, the push-to-talk switch operating conventionally to actuate the transmitter of the transceiver when the helmet wearer wishes to communicate with others via radio.

Figure 2:
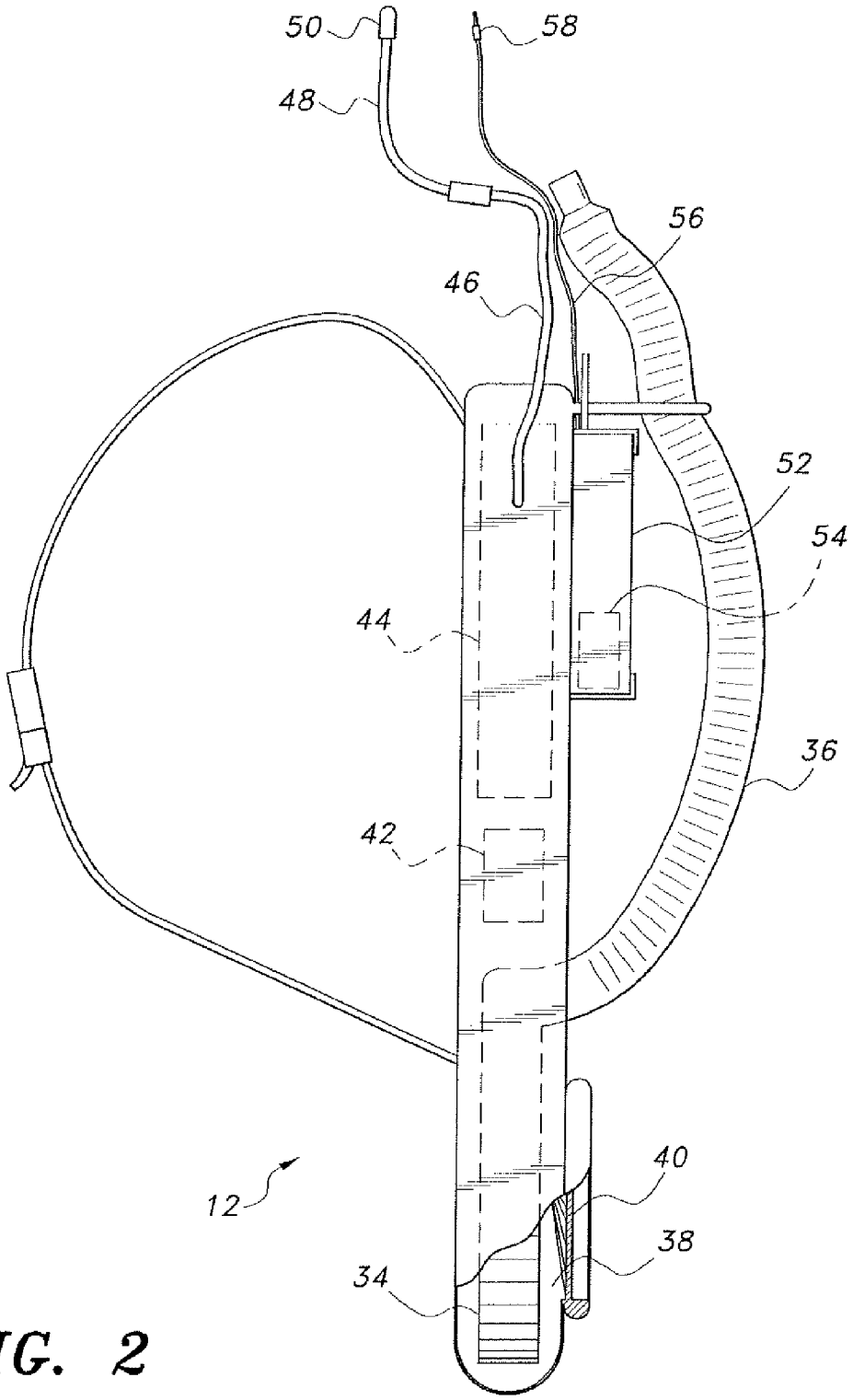
FIG. 2 is a detailed left side elevation view of the backpack portion of the environmental system for motorsports helmets according to the present invention, the backpack being broken away and partially in section to illustrate additional features thereof.
Figure 3:
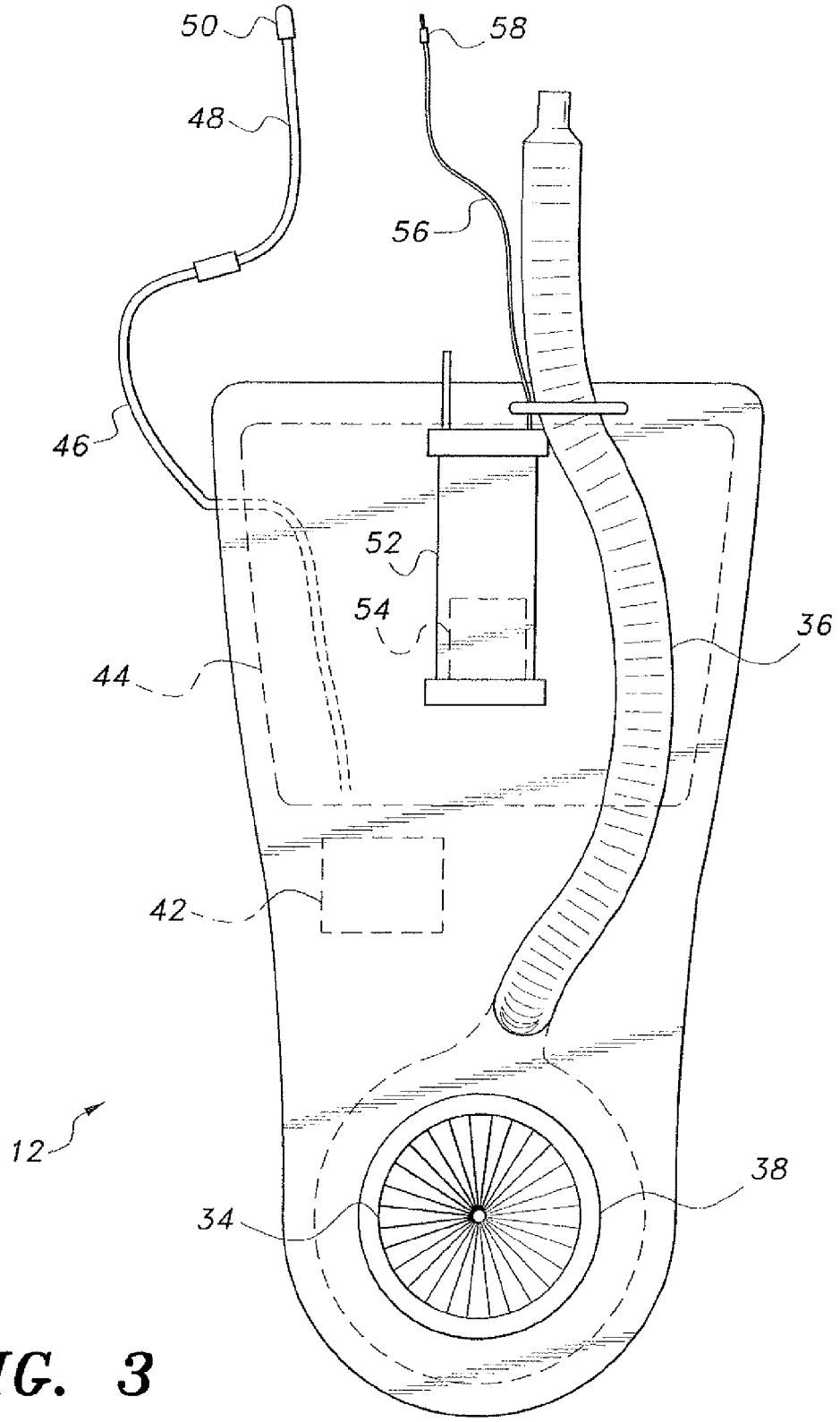
FIG. 3 is a detailed rear elevation view of the backpack portion of the environmental system for motorsports helmets according to the present invention, illustrating additional features thereof.

The wearer of the helmet 10 carries a backpack 12 that houses additional components of the system. The environmental left side elevation view of FIG. 1 also shows the backpack 12 with the helmet 10, but FIGS. 2 and 3 respectively provide larger left side and rear elevation views of the backpack 12 that carries or includes most of the mechanisms that function to provide the various environmental features of the helmet. The backpack 12 includes an electrically powered ventilation fan 34, e.g., a centrifugal or "squirrel cage" blower, that delivers air to an air delivery line, tube, or duct 36 that extends from an outlet on the backpack 12 to connect removably to the ventilation inlet 26 at the lower back of the helmet 10. The fan 34 draws air into the backpack 12 through an air inlet 38. An air filter 40 is installed over the inlet 38. An electric power supply 42 (electrical storage battery or cells, etc.) is provided within the backpack 12 to power the fan 34. The wearer of the helmet 10 and backpack 12 need only actuate an electrical switch to actuate the fan 34, thereby delivering fresh, filtered air to the face of the helmet wearer by means of the fan 34, air delivery line 36, and ducts 22 and 24 within the helmet 10.

The backpack 12 also contains a water container 44 therein for the carriage of a supply of drinking water for the wearer of the helmet 10 and backpack 12. A water delivery line 46 extends from the water container 44 out from the backpack 12 and is connected removably to a water delivery tube 48 (not shown in the helmet 10 in FIG. 1, but shown in FIGS. 2 and 3) that is placed or installed in the helmet 10 before donning the helmet 10. The distal end of the water delivery tube 48 is provided with a conventional "bite valve" 50 that the helmet wearer places within his or her mouth when donning the helmet 10. When the helmet wearer wishes to take a drink, he or she need only bite down or compress the valve 50 to open the valve 50, whereupon the user may suck on the end of the tube 48 and its "bite valve" 50 to draw water from the container 44 of the backpack 12.

The backpack 12 also provides for the carriage of a two-way radio transceiver 52. The transceiver 52 may be secured on or in a rack on the back of the backpack 12, generally as shown in the drawings, or may be contained within a compartment in the backpack if such a compartment is provided. The transceiver 52 is conventional and contains its own dedicated electrical storage battery power supply 54 therein, separate from the electrical power supply 42 used to power the ventilation fan 34. An external communications cable 56 extends from the transceiver 52 and connects removably to the communications cable 32 extending from the headset 28 within the helmet 10 by means of a conventional jack plug 58 and corresponding receptacle in the helmet 10 or at the end of the cable 32 within the helmet 10.

A motorsports participant or other user of the environmental system for motorsports helmets readies the system for use by donning the backpack 12, after confirming that the water supply 44 and electrical power supplies 42 and 54 are adequate. The headset 28 with its microphone 30 is then donned if this equipment is not provided integrally with the helmet 10, and the "bite valve" 50 of the water delivery tube 48 is placed in the mouth. The helmet 10 is then donned (or may be placed upon the head before donning the backpack 12, if desired). The wearer of the system then connects the air delivery line 36 from the backpack 12 to the ventilation inlet 26 of the helmet 10, the water supply line 46 from the backpack 12 to the water supply tube 48 within the helmet 10, and the communications cable 56 from the transceiver 52 to the communications cable 32 within the helmet 10. The motorsports participant is then ready to enjoy the sport in virtually any conditions, and particularly hot, dry and dusty conditions, in reasonable comfort and security provided by the fresh, filtered air, clean water supply, and communications provided by the system.

It is to be understood that the present invention is not limited to the embodiment described above, but encompasses any and all embodiments within the scope of the following claims.

We claim:

1. An environmental system for a motorsports helmet, consisting of:

a protective helmet, the helmet including a front portion, a rear portion, a top portion and a lower opening, the front portion of the helmet includes a front opening, the helmet having a selectively openable face shield at the front opening, the face shield substantially sealing the helmet when closed, the helmet further including a ventilation inlet located at the lower back of the rear portion of the helmet;

a flexible, resilient neck seal depending from the lower opening of the helmet, the neck seal has a terminal portion for sealing the helmet about the neck of a person wearing the helmet;

a pair of lower lateral ventilation ducts and an upper ventilation duct disposed within the helmet, the pair of lateral ventilation ducts and upper duct being in fluid communication with the ventilation inlet at one end thereof, the pair of lower lateral ventilation ducts extending about opposite sides of the helmet adjacent the lower opening of the helmet and terminating at the lower front portion of the helmet at the other end thereof, the upper duct extending about the top portion of the helmet and terminating at the front opening of the helmet at the other end thereof;

a water supply tube disposed within the helmet;

a communications radio headset and microphone disposed within the helmet;

a backpack having an air inlet;

an air filter disposed at the air inlet of the backpack;

a ventilation fan disposed within the backpack, the ventilation fan selectively drawing air through the air filter;

an air delivery line extending from the backpack, the air delivery line being removably connected directly to the ventilation inlet at the rear portion of the helmet, the air delivery line selectively delivering filtered air to all the ventilation ducts of the helmet when the ventilation fan is actuated;

a water container disposed within the backpack;

a water delivery line extending from the water container of the backpack to the water supply tube in the helmet, the water delivery line being removably connected directly to the helmet at the rear portion of the helmet, the water delivery line selectively delivering water to the water supply tube in the helmet;

a communications transceiver disposed with the backpack; and a communications cable extending from the transceiver, the cable being removably connected to the helmet, the communications cable selectively connecting the transceiver of the backpack to the headset and microphone of the helmet.

2. The environmental system for a motorsports helmet according to claim 1, wherein the ventilation fan is a centrifugal fan.

* * * * *